United States Patent [19]

de Werk

[11] 4,279,545

[45] Jul. 21, 1981

[54] DEVICE FOR SEALING THE LOWER PART OF A COLUMN STANDING ON OR IN THE BOTTOM BELOW A BODY OF WATER WITH RESPECT TO THE SURROUNDING SURFACE OF THE BOTTOM

[75] Inventor: Karel J. C. de Werk, Ouderkerk a.d. Ijssel, Netherlands

[73] Assignee: RSV-Gusto Engineering B.V., Rotterdam, Netherlands

[21] Appl. No.: 54,625

[22] Filed: Jul. 3, 1979

[30] Foreign Application Priority Data

Jul. 6, 1978 [NL] Netherlands ..... 7807340

[51] Int. Cl.[3] ..... E02D 31/10

[52] U.S. Cl. ..... 405/211; 405/216

[58] Field of Search ..... 405/211, 212, 216, 201, 405/202, 208, 203–207

[56] References Cited

U.S. PATENT DOCUMENTS

| | | | |
|---|---|---|---|
| 282,807 | 8/1883 | Valentine | 405/216 |
| 1,411,404 | 4/1922 | Camp | 405/216 |
| 2,870,609 | 1/1959 | Siebenhausen et al. | 405/207 |
| 3,456,488 | 7/1969 | Luque . | |
| 3,572,041 | 3/1971 | Graaf | 405/205 |
| 3,591,936 | 7/1971 | Geuns | 405/203 X |
| 3,983,705 | 10/1976 | de Boer | 405/211 |

FOREIGN PATENT DOCUMENTS

| | | | |
|---|---|---|---|
| 6815911 | 5/1970 | Netherlands . | |
| 7403530 | 9/1975 | Netherlands . | |
| 1196992 | 7/1970 | United Kingdom | 405/207 |
| 1383012 | 2/1975 | United Kingdom | 405/211 |

*Primary Examiner*—Dennis L. Taylor

*Attorney, Agent, or Firm*—Young & Thompson

[57] ABSTRACT

A device for sealing the lower part of a column standing on or in the bottom below a body of water, comprises a plate-shaped body surrounding the column, the plate-shaped body having a flexible border strip that runs around its entire circumference. The plate-shaped body is rigid and is mounted on a rigid sleeve surrounding the column and extending downwardly in the plate, the walls of the sleeve being parallel to the walls of the column. The body and the strip are of an impermeable material. Erosion of the material of the bottom from around the lower part of the column, under the influence of water currents, is thus retarded.

5 Claims, 5 Drawing Figures

DEVICE FOR SEALING THE LOWER PART OF A COLUMN STANDING ON OR IN THE BOTTOM BELOW A BODY OF WATER WITH RESPECT TO THE SURROUNDING SURFACE OF THE BOTTOM

The invention relates to a device for sealing the lower part of a column standing on or in the bottom below a body of water with respect to the surrounding surface of the bottom.

In case of columns standing in moving water, for instance on the sea bottom or river bottom the currents around the lower part of the column may cause a scouring away of the bottom, i.e. the current around the lower part of the column may cause the formation of a hole. This may happen very soon after placing the column.

When employing movable platforms or dredging apparatus having spuds or other devices provided with leglike columns in a body of water the bottom of which has a surface that may not be disturbed, the current around the lower part of the column causes a problem and the invention provides a solution for solving this problem.

The device according to the invention is therefore characterized by a plateshaped body surrounding the column, said plateshaped body at least on the circumference thereof having a flexible border strip running along the entire circumference. The upper side of this plateshaped body provides a smooth surface that can not be affected by turbulences caused by the currents, whereby the flexible border strip provides a sealing of the plateshaped body against the bottom that may have an irregular character for instance in the shape of undulations caused by the current and the like.

The plateshaped body may consist of a body that is rigid in the proximity of the column and gradually be comes more flexible in the direction of the border edge. The plateshaped body may be manufactured of either a resin or a metal in combination with a border strip of another material having sufficient flexibility. The device is suspended from pulling means keeping the plateshaped body near the end of the lower part of the column in such a manner that the plateshaped body comes to rest on the bottom when the lower part of the column further penetrates into the bottom. The device is thus slidable with respect to the column.

Preferably the plateshaped body consists of a rigid plate that is mounted on a rigid sleeve surrounding the column and extending downward with respect to the plate, while the walls of said sleeve run parallel to the walls of said column. This rigid sleeve is first to contact the bottom and will penetrate into the bottom. When lowering the column it is achieved in this way that even underneath the plate no currents will occur that might have a disturbing influence between the sleeve and the column and might as yet scour away parts of the soil. It is preferred that with respect to the sleeve the plate makes an acute angle facing the bottom. On the inside this sleeve preferably has been provided with guiding means cooperating with the walls of the column. These guiding means may be rollers and/or guide shoes.

Considering the necessity of an easy displacement of the plateshaped body with respect to the column and the profile of the column generally including toothed strips a certain clearance is required between the inner edge of the plateshaped body and the sleeve, respectively, and the column, certainly when bottom surfaces not running horizontally have to be accounted for necessitating the capability of the plateshaped body to acquire an oblique position. At the location of the toothed strips there may then be formed areas in the form of wide gaps whereby disturbing currents may still occur.

According to the invention it is therefore preferred that the gap between the sleeve and the column is sealed by means of a flexible strip sealingly engaging the walls of the column.

The flexible border strip should be capable of adapting itself as well as possible to irregularities of the bottom. This border strip may consist of a flexible sheet that therefore will be vertically draping downward as long as the plateshaped body has not yet reached the bottom. Upon a quick lowering the sheet will be opened like a parachute and come to rest on the bottom. Preferably the flexible strip will therefore be provided with spaced apart busks facilitating a uniform spreading. Preferably the busks are movably, i.e. hingedly or elastically, fastened to the plate and are coupled through pulling means to a ring located above the plate and surrounding the column, the said ring also being coupled through pulling means to said plate and being suspended from pulling means, while the pulling means between the ring and the plate and between the ring and the border strip have such lengths that in the tautened condition of the pulling means the border strip is lifted.

In this way it is achieved that upon lowering, the plateshaped body is first to contact the bottom and only thereafter the border strip will come to rest on the bottom in other words in a manner independent of the opening of the border strip like a parachute or not. Upon lifting it is achieved that the sealing border strip is lifted first whereby the release becomes easier.

When an oblique bottom has to be accounted for the plate should surround the column with a large clearance and according to the invention the inner edge thereof is then fastened through a flexible sealing strip to a ring guided on the column, surrounding said column at close clearance and being suspended from pulling means. This ring maintains a position perpendicular to the axis of the column whereas the sealing strip seals of the clearance. This sealing strip may be constructed in such a manner that it either may take up pulling forces or may consist of a sheet in combination with separate pulling means between the ring and the plate.

In all embodiments it is furthermore possible to provide a ring surrounding the column and sealingly guided thereon above the plate, said ring being coupled to said plate through pulling means and carrying a flexible sheet, the latter being arranged around the column and the outer edge thereof resting against or being fastened, respectively, to the flexible border strip. In all conceivable embodiments a satisfactory sealing may be obtained therewith.

In the device according to the invention the currents occurring around the column will find a surface surrounding the column that cannot be affected by the currents. The device may extend far from the column so that the entire bottom area around the column otherwise open to detrimental effects of the currents is protected.

The invention will now be described further in detail with respect to the drawings in which FIG. 1 shows a plan view of an embodiment of the device according to the invention;

FIG. 2 shows a cross section of the device according to the invention;

FIGS. 3 and 4 schematically show a modification of the device of FIGS. 1 and 2 in different positions, and FIG. 5 shows another possible embodiment.

With reference to FIGS. 1 and 2 there has been shown a column 1 having a rectangular cross section and provided with four toothed strips 2.

The device according to the invention shown in these figures includes a rectangular sleeve 3 that is guided on the walls of the column by means of rollers 4 and guide shoes 5. This sleeve has an octagonal plate 6 slightly inclining downwards from the upper edge of the sleeve, which plate 6 is reinforced with ribs 7.

This body consisting of the sleeve and the plate may be manufactured of a plastic material, such as fiber glass reinforced polyester or of a metal, such as steel.

To the edge of the plate 6 there is fastened a flexible strip 8, the edge of which may be loaded, if desired, with small weights 9.

The whole assembly is suspended from pulling means 10, that are mounted on the column at a higher level, for instance a level above the water surface when the column is in lifted position.

The gap between the sleeve 3 and the walls of the column may be sealed by means of a flexible strip 11 of rubber or a resinous material.

The strip 8 may consist of resinous material, rubber, rubberized textile and the like.

At the location of the lines running through the corners of the octagonal plate and the octagonal strip are busks 12 on the flexible strip 8 facilitating the spreading of the border strip upon lowering the body. At their inner ends these may be fastened to the plate and perform their function due solely to the elasticity thereof although they may also be hingedly fastened at 13 to the plateshaped body 6 as has been shown in FIG. 3.

FIGS. 3 and 4 show this embodiment in which above the plateshaped body there is a ring 14 surrounding the column at a clearance and from which the plate 6 is suspended through pulling means 15. At the location of the busks 12 are pulling means 16 connected to the ring 14.

The busks may of course also be provided at other places, for instance also between the corners.

Figure 5:
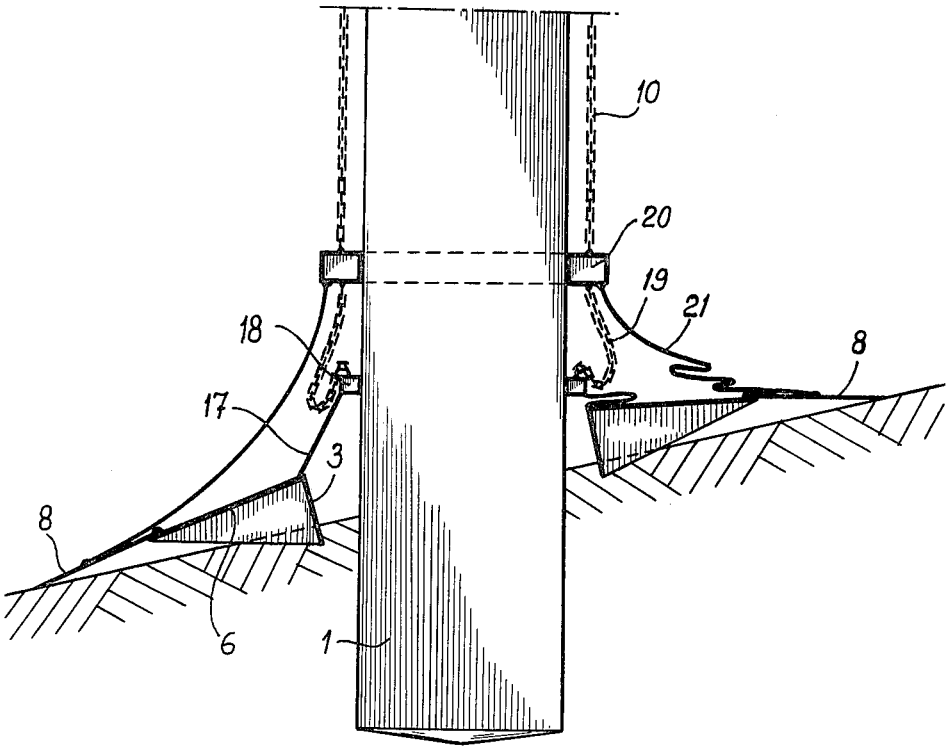

In FIG. 5 there is shown a suitable embodiment for a column that is located in an oblique bottom. By creating a sufficient clearance between the sleeve 3 and the column 1 the device may adapt itself to the course of the bottom, by taking an oblique position.

In order to seal the gap there is a flexible strip 17 connecting the upper edge of the plate 6 with a ring 18, for instance of a resinous material, said ring having an inner profile adapted in such a manner to the profile of the column that the ring may slide over the column although sealing the same with respect to the column sufficiently for preventing currents. If necessary this flexible strip 17 may be constructed in such a manner that by means thereof the device may be suspended from the ring 18 the latter being coupled through pulling means 19 to the pulling means 10.

In FIG. 5 there is shown a second ring 20 likewise surrounding the column at a slight clearance and adapted to the profile of the column to which second ring 20 a flexible sheet 21 is fastened that extends around the column and rests upon the flexible border strip 8.

The ring 20 and the sheet 21 may be employed in combination with the ring 18 and the sealing 17 as has been shown in FIG. 5.

Figure 1:
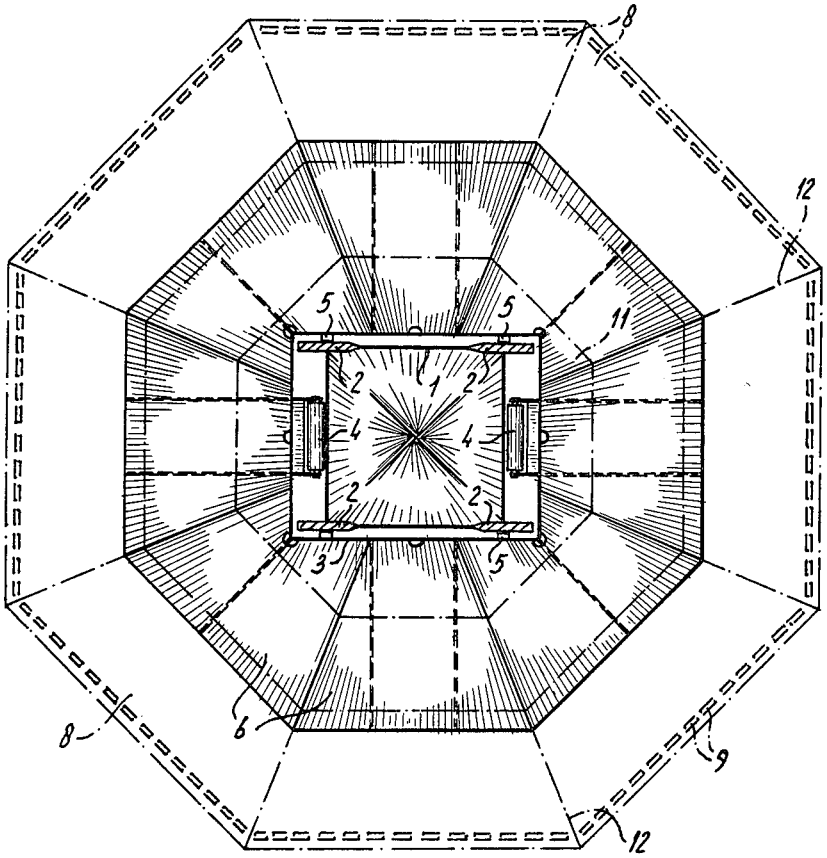
Figure 2:
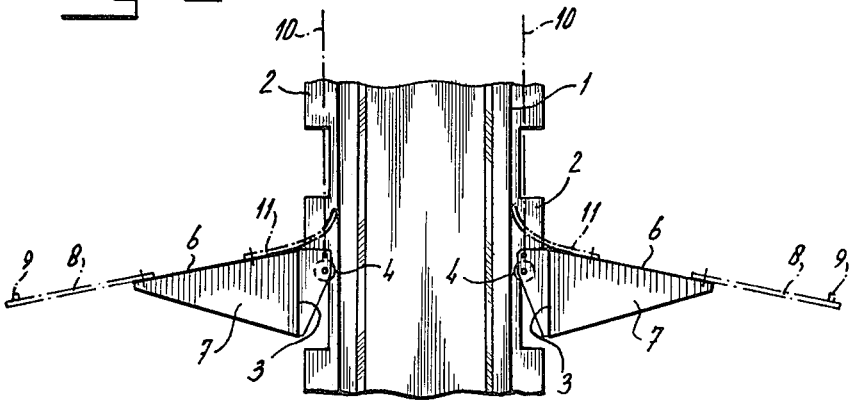
Figure 3:
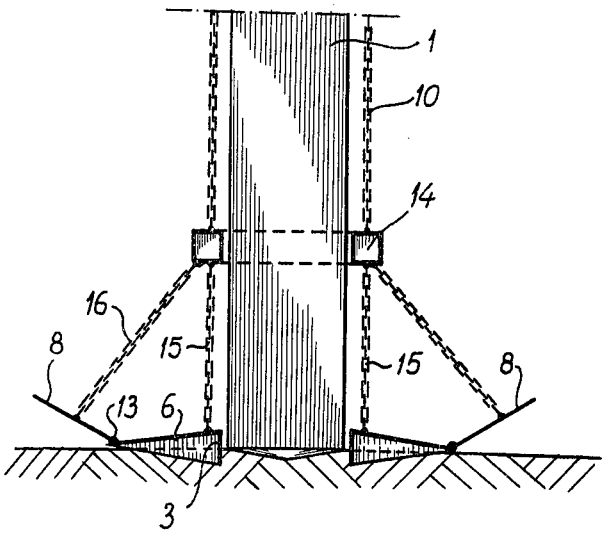
FIG. 3 shows the device according to the invention at the moment the device touches the bottom or is released therefrom. The pulling means 15 and 16 are then in tautened condition, which means that the busks have been lifted and consequently the border strip has been lifted too.
Figure 4:
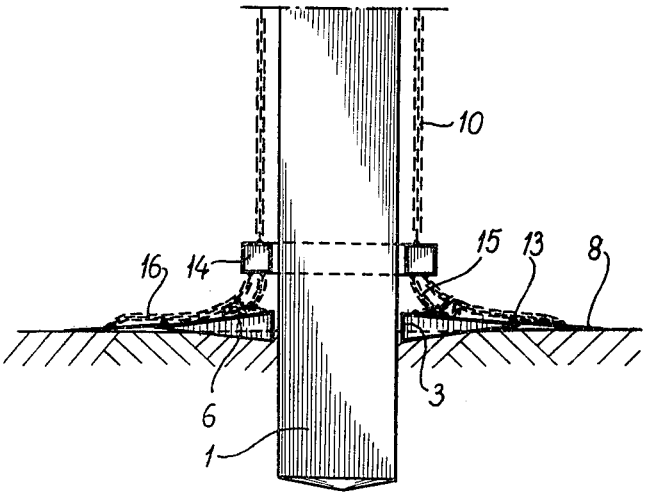
FIG. 4 shows this embodiment in completely lowered condition with all pulling means slackened whereby the border strip thus has been adapted to the bottom.

It is however also conceivable to use only the ring 20 and the flexible sheet 21 and accordingly, for instance as a modification of the device of FIG. 3 there may be employed a ring 20 instead of the ring 14 shown in FIG. 3, said ring closely engaging the column and in which the flexible sheet 21 either drapes over the pulling means 16 or takes the place of these pulling means.

What is claimed is:

1. A device for sealing the lower part of a column standing on or in the bottom below a body of water with respect to the surrounding surface of the bottom characterized by a plate-shaped body surrounding the column, said plate-shaped body at least on the circumference thereof having a flexible border strip running along the entire circumference, said plateshaped body being a rigid plate mounted on a rigid sleeve surrounding the column and extending downward with respect to the plate, the walls of said sleeve being parallel to the walls of said column, both said body and said strip being of impermeable material.

2. The device of claim 1, characterized in that the border strip has spaced apart busks.

3. The device of claim 2, characterized in that the busks are movably fastened to the plate and are coupled through pulling means to a ring located above the plate and surrounding the column, the said ring also being coupled through pulling means to said plate and being suspended from pulling means while the pulling means between the ring and the plate and between the ring and the border strip have such lengths that in the tautened condition of the pulling means the border strip is lifted.

4. The device of claim 1, characterized in that the plate surrounds the column with a large clearance, while the inner edge thereof is fastened through a flexible sealing strip to a ring guided on the column, surrounding said column at close clearance and suspended from pulling means.

5. The device of claim 1, characterized by a ring above the plate, said ring closely surrounding the column and being guided thereon and furthermore being coupled to said plate through pulling means and carrying a flexible sheet, the latter being arranged around the column and the outer edge of which rests against or has been fastened to the flexible border strip of the plate.

* * * * *